US005382492A

United States Patent [19]

El-Sayed et al.

[11] Patent Number: 5,382,492

[45] Date of Patent: Jan. 17, 1995

[54] QUATERNARY AMMONIUM COMPOUND AS CHARGE ADJUVANTS FOR POSITIVE ELECTROSTATIC LIQUID DEVELOPERS

[75] Inventors: Lyla M. El-Sayed, Kennett Square, Pa.; Gregg A. Lane, San Diego, Calif.; Kathryn A. Pearlstine, Wilmington, Del.

[73] Assignee: Xerox Corporation, Stamford, Conn.

[21] Appl. No.: 159,004

[22] Filed: Nov. 29, 1993

[51] Int. Cl.[6] ..... G03G 9/135

[52] U.S. Cl. ..... 430/115; 430/137

[58] Field of Search ..... 430/115, 137

[56] References Cited

U.S. PATENT DOCUMENTS

| | | | |
|---|---|---|---|
| 3,893,935 | 7/1975 | Jadwin et al. | 430/110 |
| 3,977,983 | 8/1976 | Tsuneda | 430/115 |
| 3,985,663 | 10/1976 | Lu et al. | 430/115 |
| 4,229,513 | 10/1980 | Merrill et al. | 430/115 |
| 4,606,989 | 8/1986 | Uytterhoeven et al. | 430/115 X |
| 4,783,388 | 11/1988 | El-Sayed et al. | 430/115 |
| 4,960,666 | 10/1990 | Weagley et al. | 430/114 X |
| 5,009,980 | 4/1991 | El-Sayed et al. | 430/137 X |

FOREIGN PATENT DOCUMENTS

| | | | |
|---|---|---|---|
| 12838 | 1/1977 | Japan | 430/115 |

*Primary Examiner*—Roland Martin

*Attorney, Agent, or Firm*—John L. Haack

[57] ABSTRACT

A positive-working electrostatic liquid developer consisting essentially of (A) a nonpolar liquid having a Kauri-butanol value of less than 30, present in a major amount;(B) thermoplastic resin particles having dispersed therein a quaternary ammonium compound which is substantially insoluble in the nonpolar liquid and is represented by the general formula:

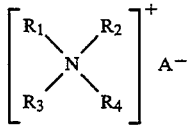

wherein $R_1$, $R_2$, $R_3$, and $R_4$ may be the same or different and are hydrogen, alkyl of 1 to 40 carbon atoms, aryl of 6 to 30 carbon atoms, and any of the group $R_1$, $R_2$, $R_3$, and $R_4$ may be joined to form a 5 or 6 membered ring, and $A^-$ is an anion; and (C) a nonpolar liquid soluble ionic or zwitterionic charge director compound. The process of preparation of the electrostatic liquid developer is described. The liquid developers are useful in copying, color proofing including digital color proofing, lithographic printing plates and resists.

17 Claims, No Drawings

QUATERNARY AMMONIUM COMPOUND AS CHARGE ADJUVANTS FOR POSITIVE ELECTROSTATIC LIQUID DEVELOPERS

TECHNICAL FIELD

This invention relates to electrostatic liquid developers. More particularly this invention relates to a positive-working liquid electrostatic developer containing resin particles having dispersed therein a quaternary ammonium compound.

BACKGROUND INFORMATION

It is known that a latent electrostatic image can be developed with toner particles dispersed in an insulating nonpolar liquid. Such dispersed materials are known as "liquid toners" or "liquid developers". A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface.

One particularly useful class of liquid toners has a thermoplastic resin dispersed in a nonpolar liquid. Generally a suitable colorant also is present, such as a dye or pigment. The colored toner particles are dispersed in the nonpolar liquid, which generally has a high-volume resistivity in excess of $10^9$ ohm centimeters, a low dielectric constant below 3.0, and a high vapor pressure. The toner particles are less than 10 μm average by area size as determined using the Horiba centrifugal particle size analyzer or less than 30 μm average particle size as determined using a Malvern 3600E particle Sizer, both described below. After the latent electrostatic image has been formed, the image is developed by the colored toner particles dispersed in the nonpolar liquid. The image subsequently may be transferred to a carrier sheet.

Since the formation of proper images depends on the differences of the charge between the liquid developer and the latent electrostatic image, it is desirable to add a charge director compound and preferably adjuvants (e.g., polyhydroxy compounds, aminoalcohols, polybutylene succinimide, and aromatic hydrocarbons) to the liquid developer. Such liquid developers provide images of good resolution, but it has been found that charging and image quality are particularly dependent on the specific pigment that was selected. Some formulations suffer from poor image quality, manifested by low resolution, poor solid area coverage (density), and/or non-uniform coverage. Much research effort has been expended to develop new type charge directors and/or charging adjuvants for electrostatic liquid toners that are not as sensitive to the specific selected pigment.

SUMMARY OF THE INVENTION

It has been found that the above disadvantages can be overcome, and improved positive developers prepared, when the thermoplastic resin has dispersed therein an adjuvant of the invention, and preferably a colorant. The improved electrostatic liquid developer results in improved image quality, reduced squash, improved solid area coverage independent of the selected pigment and charge director compound present. The developer has good conductivity with improved mobility of the resin or toner particles.

Accordingly, this invention provides a positive-working electrostatic liquid developer consisting essentially of:

(A) a nonpolar liquid having a Kauri-butanol value of less than 30, present in a major amount;

(B) thermoplastic resin particles having dispersed therein a quaternary ammonium compound which is substantially insoluble in the nonpolar liquid and is represented by the general formula:

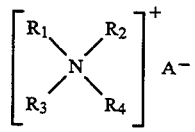

wherein $R_1$, $R_2$, $R_3$, and $R_4$ may be the same or different and are hydrogen, alkyl of 1 to 40 carbon atoms, aryl of 6 to 30 carbon atoms, and any of the group $R_1$, $R_2$, $R_3$, and $R_4$ may be joined to form a 5 or 6 membered ring, and $A^-$ is an anion; and (C) a nonpolar liquid soluble ionic or zwitterionic charge director compound.

This invention also provides a process for preparing a positive-working electrostatic liquid developer for electrostatic imaging comprising (A) dispersing at an elevated temperature in a vessel a thermoplastic resin, a dispersant nonpolar liquid having a Kauri-butanol value of less than 30, and a quaternary ammonium compound which is substantially insoluble in the nonpolar liquid and is represented by the general formula:

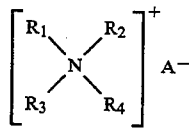

wherein $R_1$, $R_2$, $R_3$, and $R_4$ may be the same or different and are hydrogen, alkyl of 1 to 40 carbon atoms, aryl of 6 to 30 carbon atoms, and any of the group $R_1$, $R_2$, $R_3$, and $R_4$ may be joined to form a 5 or 6 membered ring, and $A^-$ is an anion, while maintaining the temperature in the vessel at a temperature sufficient to plasticize and liquify the resin and below that at which the dispersant nonpolar liquid degrades and the resin and quaternary ammonium compound decompose, (B) cooling the dispersion, either (1) without stirring to form a gel or solid mass, followed by shredding the gel or solid mass and grinding by means of particulate media;

(2) with stirring to form a viscous mixture and grinding by means of particulate media; or (3) while grinding by means of particulate media to prevent the formation of a gel or solid mass;

(C) separating the dispersion of toner particles having an average by area particle size of less than 10 μm from the particulate media, and (D) adding to the dispersion during or subsequent to Step (A) a nonpolar liquid soluble ionic or zwitterionic charge director compound.

DESCRIPTION OF THE PREFERRED EMBODIMENTS

Throughout the specification and claims,the below-listed terms have the following meanings:

"Consisting essentially of" means the composition of the electrostatic liquid developer may include unspecified components that do not prevent the advantages of the developer from being realized. For example, in addition to the primary components, there may be present additional components, such as a colorant, fine particle size oxides, one or more adjuvants (e.g., aminoalcohol, polybutylene succinimide, aromatic hydrocarbon), etc.

"Aminoalcohol" means there is both an amino functionality and a hydroxyl functionality in one compound.

"Conductivity" is the conductivity of the developer measured in picomhos (pmhos/cm) at 5 hertz and 5 volts.

"Mobility" means the movement of the resin or toner particles in the liquid electrostatic developer expressed in $m^2/Vsec$ ($X10^{-10}$) where V is volts.

NONPOLAR LIOUID

The dispersant nonpolar liquids (A) preferably are branched-chain aliphatic hydrocarbons and more particularly Isopar ®-G, Isopar ®-H, Isopar ®-K, Isopar ®-L, Isopar ®-M and Isopar ®-V. These hydrocarbon liquids are narrow cuts of isohydrocarbon fractions with extremely high levels of purity. For example, the boiling range of Isopar ®-G is between 157° C. and 176° C., Isopar ®-H between 176° C. and 191° C., Isopar ®-K between 177° C. and 197° C., Isopar ®-L between 188° C. and 206° C. and Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications limit impurities, such as sulphur, acids, carboxyl, and chlorides to a few parts per million. The nonpolar liquids selected typically are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used to advantage. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method.

While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature.

The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the resin, including components dispersed therein, and any pigment component present.

THERMOPLASTIC RESIN

Useful thermoplastic resins (i.e., polymers) include: copolymers of acrylic or methacrylic acid and at least one alkyl ester of acrylic or methacrylic acid wherein alkyl is 1–20 carbon atoms, or other acrylic resins, including Elvacite ® Acrylic Resins, E. I. du Pont de Nemours and Co., Wilmington, Del., ethylene vinyl acetate (EVA) copolymers (Elvax ® resins, E. I. du Pont de Nemours and Company, Wilmington, Del.), copolymers of ethylene and an $\alpha,\beta$-ethylenically unsaturated acid selected from the class consisting of acrylic acid and methacrylic acid, copolymers of ethylene (80 to 99.9%)/acrylic or methacrylic acid (20 to 0%)/alkyl (C1 to C5) ester of methacrylic or acrylic acid (0 to 20%), polyethylene, polystyrene, isotactic polypropylene (crystalline), ethylene ethyl acrylate series sold under the trademark Bakelite ® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, Del., etc., or blends thereof, polyesters, polyvinyl toluene, polyamides, styrene copolymers, and modified resins disclosed in El-Sayed, Schmidt, Trout and Mitchell U.S. Pat. No. 4,798,778, and epoxy resins. The synthesis of copolymers of ethylene and an $\alpha,\beta$-ethylenically unsaturated acid of either acrylic acid or methacrylic acid is described in Rees U.S. Pat. No. 3,264,272.

For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A.

Preferred resins include acrylic resins, such as methyl methacrylate (50–90%)/methacrylic acid (0–20%)/ethyl hexyl acrylate (10–50%).

Thermoplastic resin polymers selected in the practicing invention preferably have the following characteristics:

1. Are able to disperse the colorant, e.g., pigment, adjuvant, etc.
2. Are substantially insoluble in the dispersant liquid at temperatures below 40° C., so that the resin will not dissolve or solvate in storage, 3. Are able to solvate at temperatures above 50° C. to form a homogeneous mixture with solvent,
4. Are able to be ground to form particles between 0.1 μm and 5 μm, in diameter (preferred size), e.g., determined by Horiba CAPA-500 centrifugal parti7 cle analyzer; and between 1 μm and 15 μm in diameter, e.g., determined by Malvern 3600E described below,
5. Are able to form a particle (average by area) of less than 10 μm, e.g., determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm, and less than about 30 μm average particle size, e.g., determined by Malvern 3600E Particle Sizer as described below, and
6. May be fused at temperatures in excess of 70° C.

CHARGE DIRECTOR(S)

Suitable nonpolar liquid soluble ionic or zwitterionic charge director compounds (typically used in an amount of 0.1 to 10,000 mg/g, preferably 1 to 1000 mg/g developer solids) include: positive charge directors, e.g., glyceride charge directors such as Emphos® D70-30C and Emphos® F27-85, two commercial products sold by Witco Chemical Corp., New York, N.Y.; which are sodium salts of phosphated mono- and diglycerides with unsaturated and saturated acid substituents respectively, lecithin, Basic Barium Petronate®, Neutral Barium Petronate®, Basic Calcium Petronate®, Neutral Calcium Petronate®, oil-soluble petroleum sulfonates, manufactured by Sonneborn Di7 vision of Witco Chemical Corp., supra, etc.

QUATERNARY AMMONIUM COMPOUNDS

Quaternary ammonium compounds selected in practicing the invention are substantially insoluble in the nonpolar liquid and are represented by the formula:

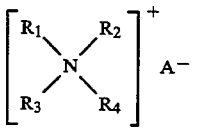

wherein $R_1$, $R_2$, $R_3$, and $R_4$ may be the same or different and are hydrogen, alkyl of 1 to 40 carbon atoms, aryl of 6 to 30 carbon atoms, and any of the group $R_1$, $R_2$, $R_3$, and $R_4$ may be joined to form a 5 or 6 membered ring, and $A^-$ is an anion. Representative anions are sulfate, chlorate, borate, acetate, nitrate, and halogen such iodide, chloride and bromide anions.

Examples of useful quaternary ammonium compounds are: cetylpyridium chloride, tetraethylammonium chloride, benzylacetyldimethylammonium chloride, tetrapentylammonium bromide, tetraphenlammonium bromide, tetrabutylammonium nitrate, tetrabutylammonium perchlorate, benzylcetyldimethylammonium chloride, cetyltrimethylammonium hexacyanoferrate, block copolymer of methylmethacrylate/butylmethacrylate and 2-(N,N-dimethylamino) ethyl methacrylate quaternized with benzyl chloride and quaternized with methyl-p-toluene sulfonate.

The quaternary ammonium compounds are present in the developer in an amount of about 0.1 to 10% by weight, preferably about 1 to 5% by weight, based on the total weight of the developer solids. Methods whereby the quaternary ammonium compounds are dispersed in the liquid electrostatic developer are described below.

ADDITIONAL COMPONENTS

Additional components that can be present in the electrostatic liquid developer are colorants, such as pigments or dyes and combinations thereof, which are preferably present to render the latent image visible, though this is not necessary for some applications. The colorant (e.g., a pigment) may be present in the amount of up to about 60 percent by weight based on the total weight of developer solids, preferably 0.01 to 30% by weight based on the total weight of developer solids. The amount of colorant may vary depending on the use of the developer. Representative pigments are disclosed in U.S. Pat. No. 5,002,848.

Other ingredients may be added to the electrostatic liquid developer, such as fine particle size oxides. For example, silica, alumina, titania, and the like, preferably in the order of 0.5 μm or less, can be dispersed into the liquefied resin. These oxides can be used alone or in combination with the colorants. Metal particles can also be added.

Another optional component of the electrostatic liquid developer is an adjuvant such as aminoalcohol, polybutylene succinimide and aromatic hydrocarbon having a Kauri-butanol value of greater than 30. The adjuvants are generally used in an amount of 1 to 1000 mg/g, preferably 1 to 200 mg/g developer solids, as disclosed in U.S. Pat. No. 5,002,848.

The particles in the electrostatic liquid developer have an average by area particle size of less than 10 μm. Preferably the average by area particle size is less than 5 μm. The resin particles may or may not be formed having a plurality of fibers integrally extending therefrom, although the presence of fibers extending from the toner particles is preferred. The term "fibers" as used herein means pigmented toner particles formed with fibers, tendrils, tentacles, threadlets, fibrils, ligaments, hairs, bristles, or the like.

DEVELOPER PREPARATION

The positive electrostatic liquid developer can be prepared by a variety of processes. For example, the thermoplastic resin(s), dispersant liquid and quarternary ammonium compound(s) may be placed into a suitable mixing or blending vessel such as an attritor, heated ball mill, heated vibratory mill, [e.g., a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two-roll heated mill (no particulate media necessary)]. Generally the resin, nonpolar liquid, quaternary ammonium compounds, and optional colorant are placed in the vessel prior to starting the dispersing step. Optionally the colorant can be added after homogenizing the resin and the dispersant nonpolar liquid. Polar liquid can also be present in the vessel, e.g., up to 100% based on the weight of total developer liquid.

The dispersing step is generally accomplished at elevated temperature (i.e., the temperature of ingredients in the vessel being sufficient to plasticize and liquefy the resin but being below that at which the dispersant nonpolar liquid or polar liquid, if present, degrades and the resin, quaternary ammonium compounds and/or colorant, if present, decompose). A preferred temperature range is 80° to 120° C. Other temperatures outside this range may be suitable, however, depending on the particular ingredients used. The presence of irregularly moving particulate media in the vessel is preferred to prepare the dispersion of toner particles. Other stirring means can be used, however, to prepare dispersed toner particles of proper size, configuration and morphology. Useful particulate media are particulate materials, e.g., spherical, cylindrical, etc. selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to about 13 mm).

After dispersing the ingredients in the vessel (with or without a polar liquid present) until the desired dispersion is achieved, typically 2 hours with the mixture being fluid, the dispersion is cooled, typically to the range of 0° C. to 50° C. Cooling may be accomplished in the same vessel, such as the attritor, while simultaneously grinding with particulate media to prevent the formation of a gel or solid mass; without stirring to form a gel or solid mass, followed by shredding the gel or solid mass and grinding (e.g., by means of particulate media); or with stirring to form a viscous mixture and grinding by means of particulate media. Additional liquid may be added at any step during the preparation of the liquid electrostatic toners to facilitate grinding or to dilute the toner to the appropriate % solids needed for toning.

Cooling is accomplished by means known to those skilled in the art and is not limited to the circulation of coolant through an external jacket, or permitting the dispersion to cool to ambient temperature.

The resin precipitates out of the dispersant during the cooling. Toner particles of average particle size (by area) of less than 10 μm, as determined by a Brinkmann Instruments, Inc., Westbury, N.Y., particle Sizer or other comparable apparatus, are formed by grinding for a relatively short period of time. Another instrument used to measure particle sizes is a Malvern 3600E Particle Sizer manufactured by Malvern, Southborough, Mass. which uses laser diffraction light scattering of stirred samples to determine average particle sizes. Since these two instrument use different techniques to measure average particle size the readings differ.

After cooling and separating the dispersion of toner particles from the particulate media (if present), it is possible to reduce the concentration of the toner parti7 cles in the dispersion, impart an electrostatic charge of predetermined polarity to the toner particles, or a combination of these variations known to those skilled in the art. The concentration of the toner particles may be reduced by the addition of additional dispersant nonpolar liquid as described above. Dilution is normally conducted to reduce the concentration of toner particles to between 0.1 to 10 percent by weight, preferably 0.3 to 3.0, most preferably 0.5 to 2 weight percent, with respect to the dispersant nonpolar liquid.

One or more ionic or zwitterionic charge director compounds (C), of the type set out above, can be added to impart a positive charge. The addition may occur at any time during the process; preferably at the end of the process. If a diluting dispersant nonpolar liquid is also added, the charge director compound can be added prior to, concurrently with, or subsequent thereto. If an adjuvant has not previously been added in the preparation of the developer, it can be added prior to or subsequent to the developer being charged.

Other process embodiments for preparing the electrostatic liquid developer include:

(A) dispersing a thermoplastic resin, optionally a colorant, and/or a quaternary ammonium compound of the invention in the absence of a dispersant nonpolar liquid having a Kauri7butanol value of less than 30 to form a solid mass,
(B) shredding the solid mass,
(C) grinding the shredded solid mass by means of particulate media in the presence of a polar liquid having a Kauri7butanol value of at least 30 and/or a nonpolar liquid having a Kauri7butanol value of less than 30,
(D) separating the dispersion of toner particles having an average by area particle size of less than 10 μm from the particulate media,
(E) adding additional nonpolar liquid, polar liquid or combinations thereof to reduce the concentration of toner particles to between 0.1 to 15 percent by weight with respect to the liquid, and
(F) adding to the dispersion a nonpolar soluble ionic or zwitterionic charge director compound;

(A) dispersing a thermoplastic resin, optionally a colorant, and/or a quaternary ammonium compound of the invention in the absence of a dispersant nonpolar liquid having a Kauri7butanol value of less than 30 to form a solid mass,
(B) shredding the solid mass,
(C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin, quaternary ammonium compound, and/or colorant decompose,
(D) cooling the dispersion, either
  (1) without stirring to form a gel or solid mass, followed by shredding the gel or solid mass and grinding by means of particulate media with or without the presence of additional liquid;
  (2) with stirring to form a viscous mixture and grinding by means of particulate media with or without the presence of additional liquid; or
  (3) while grinding by means of particulate media to prevent the formation of a gel or solid mass with or without the presence of additional liquid;
(E) separating the dispersion of toner particles having an average by area particle size of less than 10 μm from the particulate media, and
(F) adding additional nonpolar liquid, polar liquid or combinations thereof to reduce the concentration of toner particles to between 0.1 to 15 percent by weight with respect to the liquid; and
(G) adding to the dispersion a nonpolar soluble ionic or zwitterionic charge director compound.

INDUSTRIAL APPLICABILITY

The positive liquid electrostatic developers of this invention demonstrate improved image quality, resolution, solid area coverage (density), and toning of fine details, evenness of toning, and reduced squash independent of charge director or pigment present. The particles are exclusively charged positive. The developers of the invention are useful in copying (e.g., making office copies of black and white as well as various colors); color proofing (e.g., a reproduction of an image using the standard colors yellow, cyan, magenta and black as desired); highlight color copying (e.g., copying of two colors, usually black and a highlight color for letterheads, underlining); etc. In copying and proofing the toner particles are applied to a latent electrostatic image and can be transferred, if desired. Other uses envisioned for the positive liquid electrostatic developers include digital color proofing, lithographic printing plates, resists, and other applications known to those skilled in the art.

EXAMPLES

The following controls and examples wherein the parts and percentages are by weight illustrate but do not limit the invention. In the examples the melt indices are determined by ASTM D 1238, Procedure A; and the average particle sizes by area were determined by a Malvern 3600 Particle Size Analyzer, or the Brinkmann Instruments, Inc., Westbury, N.Y., Particle Sizer as described above; the conductivity was measured in picomhos (pmho)/cm at 5 Hertz and low voltage, 5 volts; and the density was measured using a Macbeth densitometer model RD 918. The resolution is expressed in the controls and Examples in line pairs/mm (1 p/mm). Weight average molecular weight can be determined by gel permeation chromatography (GPC).

Image quality of the toners of the invention was determined on a modified Savin 870 copier unless specifically noted. This device consists of a Savin 870 copier with the modifications described below.

Mechanical modifications include addition of a pre-transfer corona and removing the anodized layer lrom the surface of the reverse roll while decreasing the diameter of the roll spacers to maintain the same gap between the roll and photoconductor.

Electrical modifications include:

(1) disconnecting the image density feedback loop from the development electrode and connecting the electrode to a Keithly high voltage supply (model 247), (Keithly, Cleveland, Ohio)

(2) connecting a Keithly high voltage supply (model 247) to the modified reverse roll (3) disconnecting the transfer corona and connecting same to a Trek (model 610) high voltage supply, (Trek, Medina, N.Y.).

The modified Savin 870 was then used to evaluate both positive and negative toners depending on the voltages and biasses used. To evaluate positive toners the copier was run in a positive mode: reversed image target was used with negative transfer corona voltages and positive development bias. The reversed image target consists of white characters and lines, etc. on a black background.

The principle of operation is described below. The photoconductor is charged positive (near 1000 V) by means of the charging corona. The copy is imaged onto the photoconductor inducing the latter to discharge to lower voltages (in order of increasing discharge-black areas and white areas). When adjacent to the toner electrode the photoconductor has fields at its surface such that positive toner will deposit at the white imaged areas, negative toner at the black imaged areas. If necessary toner background is removed by the biased reverse roll. The toner is then transferred to paper by the transfer corona (the transfer force due to the negative charge sprayed on the back of the paper). The toner is then thermally fused. Actual voltages and biases used can be found in the examples.

Control 1

In a Union Process 1S attritor, Union Process Company, Akron, Ohio, were placed the following ingredients:

| INGREDIENT | AMOUNT (g) |
|---|---|
| Terpolymer of methyl methacrylate(67.3%), methacrylic acid (3.1%), and ethylhexyl acrylate (29.6%). Weight average molecular weight is 172,000, acid no. 13. | 350 |
| Isopar ® L, non-polar liquid having Kauri-butanol value of 27 (Exxon Corp.) | 946 |

The ingredients were heated to 80° C. and milled with 0.1875 inch (4.76 mm) diameter stainless steel balls for 1 hour. The attritor was cooled to 23° C. while milling was continued. 1037 grams of Isopar ® L were added. Milling continued for 16 hours to obtain toner particles with an average size of 5.2 μm by area as measured on the Malvern Particle Sizer. The particulate media were removed and the toner was diluted to 1% solids with additional Isopar ® L. To this dispersion was added 50 mg of Basic Barium Petronate ® (Witco Corp.) per gram of toner solids. The polarity and mobility of the toner was measured and is given in Table I.

Example 1

In a Union Process 01 attritor, Union Process Company, Akron, Ohio, were placed the following ingredients:

| INGREDIENT | AMOUNT (g) |
|---|---|
| Terpolymer of methyl methacrylate(67.3%), methacrylic acid (3.1%), and ethylhexyl acrylate (29.6%). Weight average molecular weight is 172,000, acid no. 13. | 44.1 |
| Cetylpyridinium chloride monohydrate, Aldrich Chem. Co., Milwaukee, WI. | 0.9 |
| Isopar ® L, non-polar liquid having Kauri-butanol value of 27 (Exxon Corp.) | 100 |

The ingredients were heated in the range of 90° C. to 110° C. and milled with 0.1875 inch (4.76 mm) diameter stainless steel balls for 2 hours. The attritor was cooled to 42° C. to 50° C. while milling was continued. Additional Isopar ® L was added and milling continued for one and a half hours to obtain toner particles with an average size of 5.5 μm by area as measured on the Malvern Particle Sizer. The particulate media were removed and the toner was diluted to 1% solids with additional Isopar ® L. To this dispersion was added 50 mg of Basic Barium Petronate ® (Witco Corp.) per gram of toner solids. The polarity and mobility of the toner was measured and is given in Table I.

Example 2

The toner was prepared as in example 1, except that instead of cetylpyridinium chloride monohydrate, 0.9 g tetraethylammonium acetate tetrahydrate was added. After cooling, the mixture was ground for 19 hours to obtain toner particles with an average size of 4.5 μm. The polarity and mobility of the toner was measured and is given in Table I.

Example 3

The toner was prepared as in example 1, except that instead of cetylpyridinium chloride monohydrate, 0.9 g benzylacetyldimethylammonium chloride monohydrate was added. After cooling, the mixture was ground for 19 hours and 45 minutes to obtain toner particles with an average size of 6.0 μm. The polarity and mobility of the toner was measured and is given in Table I.

TABLE I

| Toner | Polarity | Mobility ($\times 10^{-10}$ $m^2$/Vsec) |
|---|---|---|
| C1 | − | 4.1 |
| E1 | − | 1.7 |
| E2 | + | 4.1 |
| E3 | − | 2.0 |

Control 2

In a Union Process is attritor, Union Process Company, Akron, Ohio, were placed the following ingredients:

| INGREDIENT | AMOUNT (g) |
|---|---|
| Terpolymer of methyl methacrylate(67.3%), methacrylic acid (3.1%), and ethylhexyl acrylate (29.6%). Weight average molecular weight is 172,000, acid no. 13. | 297.5 |
| BASF R6700 magenta pigment | 52.5 |
| Isopar ® L, non-polar liquid having Kauri-butanol value of 27 (Exxon Corp.) | 946 |

The ingredients were heated in the range of 90° C. to 110° C. and milled with 0.1875 inch (4.76 mm) diameter stainless steel balls for 1 hour. The attritor was cooled to 42° C. to 50° C. while milling was continued. 1037 grams of Isopar ® L were added. Milling continued for five and a half hours to obtain toner particles with a mean size of 6.1 μm as measured on the Brinkmann Particle Sizer. The particulate media were removed and the toner was diluted to 1% solids with additional Isopar ® L. To this dispersion was added 50 mg of Basic Barium Petronate ® (Witco Corp.) per gram of toner solids.

Image quality was determined with a Savin 870 copier with the development voltage set at 300 volts and the transfer corotron at −6 kV. Results are given in Table II.

To a separate dispersion of this developer 60 mg of Emphos ® D70-30C (Witco Corp.) were added. The polarity and mobility of the toner was measured and is given in Table III.

Example 4

In a Union Process 01 attritor, Union Process Company, Akron, Ohio, were placed the following ingredients:

| INGREDIENT | AMOUNT (g) |
|---|---|
| Terpolymer of methyl methacrylate(67.3%), methacrylic acid (3.1%), and ethylhexyl acrylate (29.6%). Weight average molecular weight is 172,000, acid no. 13. | 33.2 |

-continued

| INGREDIENT | AMOUNT (g) |
|---|---|
| BASF R6700 magenta pigment | 6.0 |
| Tetrapentylammonium bromide, Aldrich Chem. Co., Milwaukee, WI. | 0.8 |
| Isopar ® L, non-polar liquid having Kauri-butanol value of 27 (Exxon Corp.) | 100 |

The ingredients were heated in the range of 90° C. to 110° C. and milled with 0.1875 inch (4.76 mm) diameter stainless steel balls for 2 hours. The attritor was cooled to 42° C. to 50° C. while milling was continued. 60 grams additional Isopar ® L were added and milling continued for one and a half hours to obtain toner particles with a mean size of 5.2 μm as measured on the Brinkmann Particle Sizer. The particulate media were removed and the toner was diluted to 1% solids with additional Isopar ® L. To this dispersion was added 50 mg of Basic Barium Petronate ® (Witco Corp.) per gram of toner solids.

Image quality was determined with a Savin 870 copier with the development voltage set at 300 volts and the transfer corotron at −6 kV. Results are given in Table II.

To a separate dispersion of this developer 60 mg of Emphos ® D70-30C (Witco Corp.) were added. The polarity and mobility of the toner was measured and is given in Table III.

TABLE II

| Toner | Density | Transfer Efficiency | Resolution (lp/mm) | Paper |
|---|---|---|---|---|
| C2 | 0.19 | 80 | 7 | glossy |
| C2 | 0.09 | 30 | 6 | rough |
| E4 | 0.31 | 70 | 7 | glossy |
| E4 | 0.20 | 40 | 7 | rough |

TABLE III

| Toner | Charge Director | Polarity | Mobility ($\times 10^{-10}$ $m^2$/Vsec) |
|---|---|---|---|
| C2 | BBP | − | 4.3 |
| C2 | Emphos ® | + | 1.9 |
| E4 | BBP | + | 5.8 |
| E4 | Emphos ® | + | 8.4 |

Having described our invention, we claim the following and their equivalents:

1. A positive-working electrostatic liquid developer consisting essentially of (A) a nonpolar liquid having a Kauri-butanol value of less than 30, present in a major amount;

(B) thermoplastic resin particles having dispersed therein a benzylacetyldimethylammonium chloride monohydrate quaternary ammonium compound which is substantially insoluble in the nonpolar liquid; and (C) a nonpolar liquid soluble ionic or zwitterionic charge director compound.

2. An electrostatic liquid developer according to claim 1 further comprising cetylpyridinium chloride monohydrate alone or in admixture with benzylacetyldimethylammonium chloride monohydrate.

3. An electrostatic liquid developer according to claim 1 further comprising tetrapentyl ammonium bromide alone or in admixture with benzylacetyldimethylammonium chloride monohydrate.

4. An electrostatic liquid developer according to claim 1 wherein the quaternary ammonium compound is tetraethylammonium acetate tetrahydrate.

5. An electrostatic liquid developer according to claim 1 wherein component (A) is present in 85 to 99.9% by weight based on the total weight of the liquid developer, the total weight of developer solids is 0.1 to 15% by weight, the quaternary ammonium compound being present in the developer solids in an amount of about 0.1 to 10 percent by weight based on the total weight of developer solids, and component (C) is present in an amount of 0.1 to 10,000 mg/g developer solids.

6. An electrostatic liquid adeveloper according to claim 1 containing up to about 60% by weight of a colorant based on the total weight of developer solids.

7. An electrostatic liquid developer according to claim 6 wherein the colorant is a pigment.

8. An electrostatic liquid developer according to claim 6 wherein the colorant is a dye.

9. An electrostatic liquid developer according to claim 1 or 8 wherein an additional compound is present which is an adjuvant selected from the group consisting of aminoalcohol, polybutylene succinimide, and an aromatic hydrocarbon.

10. An electrostatic liquid developer according to claim 1 wherein the thermoplastic resin component (B) is a copolymer of at least one alkyl ester of acrylic or methacrylic acid wherein alkyl is 1 to 20 carbon atoms and optionally acrylic or methacrylic acid.

11. An electrostatic liquid developer according to claim 10 wherein the thermoplastic resin component is a copolymer of methyl methacrylate (50–90%)/methacrylic acid (0–20%)/ethyl hexyl acrylate (10–50%).

12. An electrostatic liquid developer according to claim 10 wherein the thermoplastic resin component is a copolymer of methyl methacrylate (67%)/methacrylic acid (3%)/ethyl hexyl acrylate (30%).

13. An electrostatic liquid developer according to claim 1 wherein the thermoplastic resin component is a copolymer of ethylene (89%)/methacrylic acid (11%) having a melt index at 190° C. of 100.

14. An electrostatic liquid developer according to claim 1 wherein the particles have an average particle size by area of less than 5 μm.

15. An electrostatic liquid developer according to claim 1 wherein component (C) is a salt of phosphated mono- and diglycerides with unsaturated or saturated acid substituents.

16. An electrostatic liquid developer according to claim 1 wherein component (C) is an oil-soluble petroleum sulfonate.

17. An electrostatic liquid developer according to claim 1 wherein the resin particles have a plurality of fibers integrally extending therefrom.

* * * * *